United States Patent [19]

Nakamura et al.

[11] 4,203,399

[45] May 20, 1980

[54] EXHAUST GAS RECIRCULATION SYSTEM

[75] Inventors: Shigefumi Nakamura, Oobu; Hiromi Tokuda, Nagoya; Hidetaka Nohira, Mishima, all of Japan

[73] Assignees: Nippondenso Co., Ltd., Kariya; Toyota Jidosha Kogyo Kabushiki Kaisha, Toyota, both of Japan

[21] Appl. No.: 922,589

[22] Filed: Jul. 6, 1978

[30] Foreign Application Priority Data

Jul. 11, 1977 [JP] Japan ..... 52/91718

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,834,363 | 9/1974 | Goto et al. | 123/119 A |
| 3,974,807 | 8/1976 | Nohira et al. | 123/119 A |
| 3,982,515 | 9/1976 | Bradshaw | 123/119 A |
| 4,041,917 | 8/1977 | Suzuki | 123/119 A |
| 4,069,797 | 1/1978 | Nohira et al. | 123/119 A |

*Primary Examiner*—Wendell E. Burns

*Attorney, Agent, or Firm*—Cushman, Darby & Cushman

[57] ABSTRACT

In an exhaust gas recirculation system of the type including a control valve inserted in an exhaust gas recirculation passageway for controlling the flow rate of the exhaust gases to be recirculated, a constant pressure chamber defined in the recirculation passageway upstream of the control valve, and a modulator valve with a diaphragm chamber in communication with the constant pressure chamber for controlling, in response to the pressure variation in the diaphragm chamber, the negative pressure which is transmitted to the control valve for operating the same, an orifice is interposed between the constant pressure chamber and the diaphragm chamber and is so contoured that the resistance to the flow from the diaphragm chamber to the constant pressure chamber is greater than the resistance to the flow from the constant pressure chamber to the diaphragm chamber.

7 Claims, 11 Drawing Figures

EXHAUST GAS RECIRCULATION SYSTEM

BACKGROUND OF THE INVENTION

The present invention relates to generally an exhaust gas recirculation system for an internal combustion engine and more particularly an exhaust gas recirculation system of the type having an exhaust gas control valve inserted in an exhaust gas recirculation passageway communicating an exhaust system with an intake system of the engine in order to control the flow rate of the exhaust gases to be recirculated in response to a negative pressure signal, a constant pressure chamber defined in the recirculation passageway upstream of the exhaust gas control valve, and a modulator valve with a diaphragm chamber in communication with the constant pressure chamber for controlling said negative pressure signal in response to the pressure variation in the diaphragm chamber, whereby the ratio of the amount of recirculated exhaust gases to the amount of intake air may be always maintained substantially constant.

In the exhaust gas recirculation system of the type described, due to the combination of the pulsation of exhaust gases, the columnar vibrations in the exhaust system and the pressure variation caused when the exhaust gas control valve is opened, the pressure in the constant pressure chamber varies with a complicated wave form including irregular components. It is not preferable to directly transmit the pressure variation in such complex waveform to the diaphragm chamber of the modulator valve. Therefore an orifice is inserted in a passageway intercommunicating the constant pressure chamber and the diaphragm chamber of the modulator valve so that the pressure variation with a substantially sinusoidal waveform may be transmitted to the diaphragm chamber by the elimination of the irregular components of the pressure variation. However with the conventional orifice, both the positive and negative pressures of the pulsating pressure are damped. Especially the damping of the positive pressure results in the decrease in the negative pressure transmission time during which the modulator valve controls to transmit the negative pressure signal to the exhaust gas flow control valve. As a result, the time interval during which the exhaust gas flow control valve is opened is decreased so that the amount of recirculated exhaust gases is decreased accordingly, whereby the NOx emission cannot be satisfactorily reduced.

SUMMARY OF THE INVENTION

In view of the above, the present invention has for its object to provide an exhaust gas recirculation system for an internal combustion engine of the type having an orifice inserted in a passageway intercommunicating a constant pressure chamber and a diaphragm chamber as described above, which system may always recirculate the exhaust gases in a suitable amount.

Briefly stated, to the above and other ends the present invention provides an orifice which is interposed between the constant pressure chamber and the diaphragm chamber and which is so contoured that the resistance to the flow from the diaphragm chamber to the constant pressure chamber is greater than the resistance to the flow from the constant pressure chamber to the diaphragm chamber. As a result, the positive pressure may smoothly enter the diaphragm chamber and may be trapped therein for a longer time. Therefore the negative pressure signal transmission time may be increased and the drop in negative pressure transmitted to the exhaust gas flow control valve may be avoided so that the recirculation of the exhaust gases in a desired amount may be always ensured.

The above and other objects, features and advantages of the present invention will become more apparent from the following description of some preferred embodiments thereof taken in conjunction with the accompanying drawings.

BRIEF DESCRIPTION OF THE DRAWINGS

Same reference numerals are used to designate similar parts throughout the figures.

DESCRIPTION OF THE PREFERRED EMBODIMENTS

Prior Art, FIGS. 1–5

Figure 1:
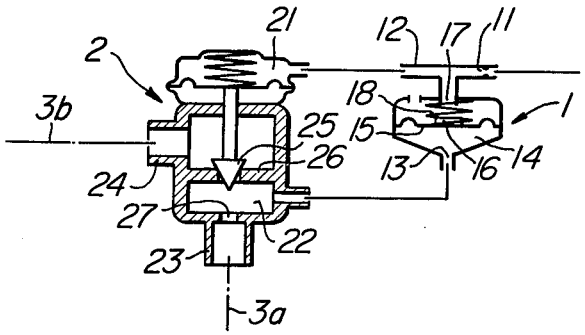
FIG. 1 PRIOR ART
FIG. 1 is a diagrammatic view of a prior art exhaust gas recirculation system.

Prior to the description of the preferred embodiments of the present invention, a prior art exhaust gas recirculation system will be briefly described with reference to FIGS. 1–5 in order to more specifically point out the problems encountered in the prior art exhaust gas recirculation systems. Referring first to FIG. 1, a first port 11 of a pressure modulator valve 1 is communicated with an exhaust gas recirculation port of a carburetor (not shown), and a second port 12 is communicated with an upper pressure chamber 21 of an exhaust gas flow control valve 2. A back pressure inlet port 13 of the modulator valve 1 is communicated with a lower or constant pressure chamber 22 of the exhaust gas control valve 2. The exhaust gas control valve 2 is inserted between exhaust gas recirculation passages **3*a* and 3*b*. An inlet pipe 23 of the exhaust gas control valve 2 is connected to the exhaust gas recirculation passage 3*a* which in turn is connected to an exhaust system of an engine (not shown). An outlet pipe 24 of the valve 2 is communicated through the exhaust gas recirculation passage 3*b* with an intake system of the engine. A valve head 25 which seats on a valve seat 26** controls the flow of exhaust gases from the passage 3*a* to the passage 3*b*. The exhaust gases flow into the constant pressure chamber 22 through a restriction 27.

The lower or constant pressure chamber 22 of the exhaust gas control valve 2 is communicated through a line and the back pressure inlet port 13 with a diaphragm chamber 14 of the pressure modulator valve 1. Therefore when the pressure in the constant pressure chamber 22 rises, a diaphragm 15 of the modulator valve 1 is deflected upwardly so that a valve body 16 closes an atmospheric port 17. As a result, the negative pressure at the exhaust gas recirculation port (not shown) is transmitted without any modification to the upper pressure chamber 21 of the exhaust gas control valve 2 so that a diaphragm of the control valve 2 is deflected upward and consequently the valve head 25 is moved away from its seat 26. Then the exhaust gases are recirculated through the passage 3*a*, the exhaust gas control valve 2 and the passage 3*b* into the intake system, whereby the emission of NOx may be suppressed as is well known in the art. When the peessure in the constant pressure chamber 22 of the exhaust gas control valve 2 drops, the diaphragm 15 of the modulator valve 1 is deflected downward under the force of a bias spring 18 so that the valve body 16 is moved away from the port 17. Then the atmospheric air is charged through the second port 12 into the upper pressure chamber 21 of the exhaust gas control valve 2 so that the diaphragm is deflected downward and consequently the valve head 25 is seated against the valve seat 26. As a result, the recirculation of the exhaust gases through the recirculation passages 3*a* and 3*b* is interrupted.

Basically the pressure modulator valve 1 is operated in the manner as described above. However the pressure variation in the constant pressure chamber 22 is not so definite that the valve body 16 on the diaphragm 15 takes only two positions to open or close the atmospheric port 17 in ON-OFF manner. In the steady state, the diaphragm 15 of the pressure modulator valve 1 is so deflected that the valve body 16 changes the resistance to the flow of the air through the atmospheric port 17, thereby controlling the negative pressure signal transmitted to the upper pressure chamber 21 of the exhaust gas control valve 2 in such a way that the valve head 25 may be so positioned as to control the flow rate of the exhaust gases from the passage 3*a* to the passage 3*b* in such a way that the pressure in the constant pressure chamber 22 may be maintained substantially equal to the atmospheric pressure.

Figure 2:
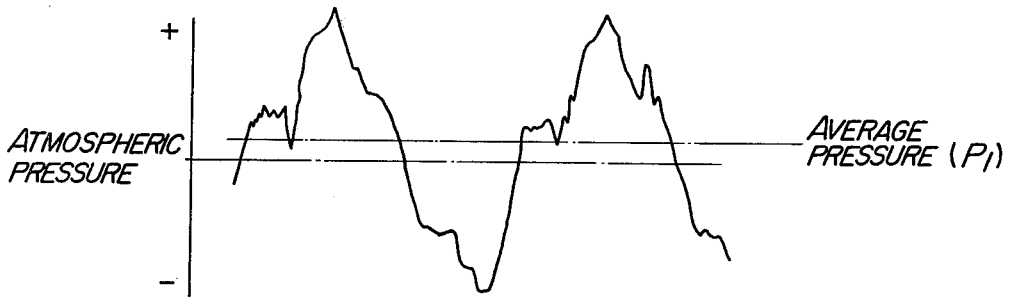
FIG. 2 PRIOR ART
FIG. 2 shows the pressure variation in time in a constant pressure chamber 22 of the prior system in FIG. 1.
Figure 3:
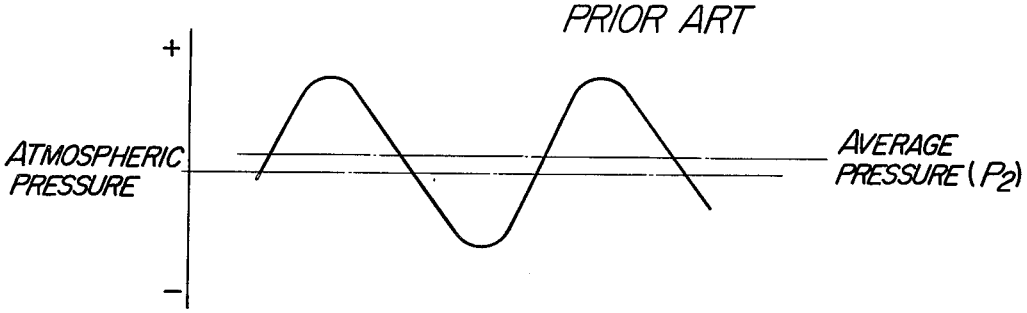
FIG. 3 PRIOR ART
FIG. 3 shows the pressure variation in a diaphragm chamber 14 of a pressure modulator valve of the prior system in FIG. 1.

However, due to the pulsation of the exhaust gases, the columnar vibrations in the exhaust system and the pressure variation caused when the exhaust gas control valve 2 is opened, the pressure in the constant pressure chamber 22 varies as shown in FIG. 2. It is apparently undesirable to use the pressure in the waveform shown as the system control signal. Therefore an orifice is inserted in the back pressure inlet port 13 of the modulator valve 1 so that the pressure having almost a sinusoidal waveform as shown in FIG. 3 may be transmitted into the diaphragm chamber 14 of the modulator valve 1. In general, the orifice hole diameter is between 1.5 and 2.5 mm depending upon the desired responsiveness and waveform.

Figure 4:
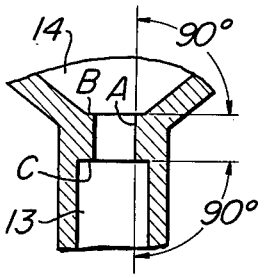
FIG. 4 PRIOR ART
FIG. 4 is a fragmentary sectional view, on enlarged scale, of a back pressure inlet port 13 of the diaphragm chamber of the prior system in FIG. 1.

FIG. 4 shows a prior art orifice formed at the back pressure inlet port 13 of the pressure modulator valve 1. In general, flat or horizontal surfaces B and C contiguous with the ends of the orifice hole at the sides of the diaphragm chamber 14 and the constant pressure chamber 22 of the exhaust gas control valve 2, respectively, are normal to the internal cylindrical surface A of the orifice hole. With the orifice having such cross sectional configuration as shown in FIG. 4, both the positive and negative pressures in the pulsating pressure are equally damped so that the average pressure $P_1$ in the constant pressure chamber 22 of the exhaust gas control valve 2 is equal to the average pressure $P_2$ in the diaphragm chamber 14 of the pressure control valve 1.

Figure 5:
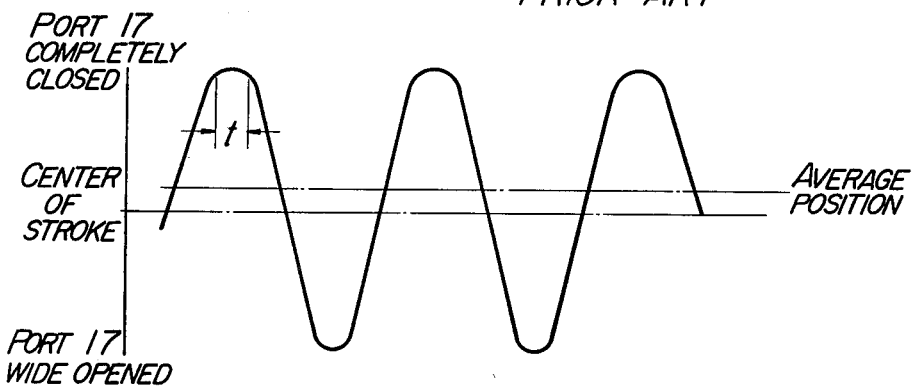
FIG. 5 PRIOR ART
FIG. 5 is a stroke-time diagram of a valve body 16 of the modulator valve, this diagram being used for the explanation of the mode of operation of the system shown in FIG. 1.

FIG. 5 shows the displacement-time diaphragm of the valve body 16 of the modulator valve 1 in response to the pressure in the diaphragm chamber 14 thereof. In general, the valve body 16 moves up and down from the point (the average position in FIG. 5) slightly offset from the center of stroke toward the upper end of the stroke (where the atmospheric port 17 is completely closed). When the positive pressure is damped through the orifice, a time t or a negative pressure transmission time during which the atmospheric port 17 is completely closed for transmitting the negative pressure at the exhaust gas recirculation port to the exhaust gas control valve 2 is shortened. As a result, the negative pressure transmitted to the exhaust gas control valve 2 drops so that the desired amount of exhaust gases cannot be recirculated and the emission of NOx cannot be satisfactorily suppressed.

The Invention

The present invention was made to overcome the above and other problems and has for its object to provide an exhaust gas recirculation system wherein an orifice is so contoured that it is easier for the positive pressure to be transmitted and held in the diaphragm chamber of the modulator valve but it is difficult for the positive pressure once trapped in the diaphragm chamber to leave it out, whereby the negative pressure transmission time may be increased and the drop of the negative pressure transmitted to the exhaust gas control valve may be avoided.

First Embodiment, FIGS. 6–9

Figure 7:
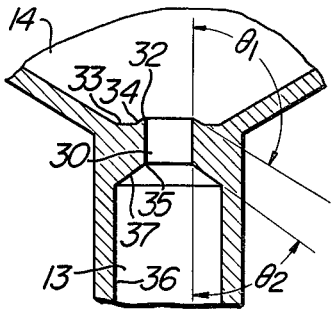
FIG. 7 is a fragmentary sectional view on enlarged scale showing the orifice arrangement of the first embodiment in FIG. 6.
Figure 6:
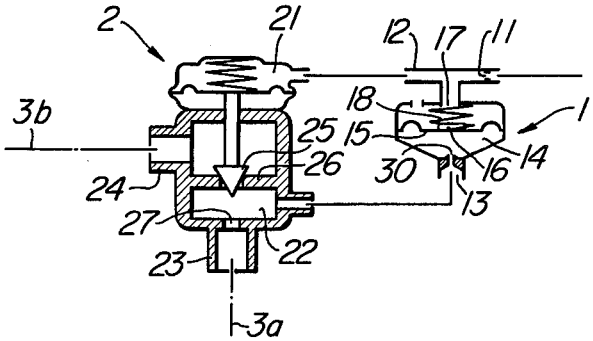
FIG. 6 is a diagrammatic view of a first embodiment of the present invention.

FIG. 6 shows a first embodiment of an exhaust gas recirculation system in accordance with the present invention. The first embodiment has a same arrangement as in the prior art shown in FIG. 1 except the configuration of an orifice 30. In FIG. 6 similar parts to those in FIG. 1 are designated with same reference numerals and are operated in combination in the manner as described with reference to FIG. 1. As shown in FIG. 7 on enlarged scale, the orifice 30 disposed at the back pressure inlet port 13 in FIG. 6 is so arranged that the upper end 32 of the orifice 30 is surrounded with an external truncated conical surface 34 which is coaxial with the orifice hole, is radially outwardly downwardly diverged and is contiguous with the flat bottom surface 33 of the diaphragm chamber 14. The angle $\theta_1$ of the taper or the angle between the external truncated conical surface 34 and the internal cylindrical surface 31 of the orifice hole is between 90° and 150°. (In case of $\theta_1=90°$, the upper end 32 flushes with the flat surface 33.) In like manner, the lower end 35 of the orifice hole is contiguous with an internal truncated conical surface 37 which is tapered toward the internal cylindrical surface 36 of the back pressure inlet port 13. The angle $\theta_2$ of the taper or the angle between the internal truncated conical surface 37 and the internal cylindrical surface 31 is between 10° and 70°.

Figure 8:
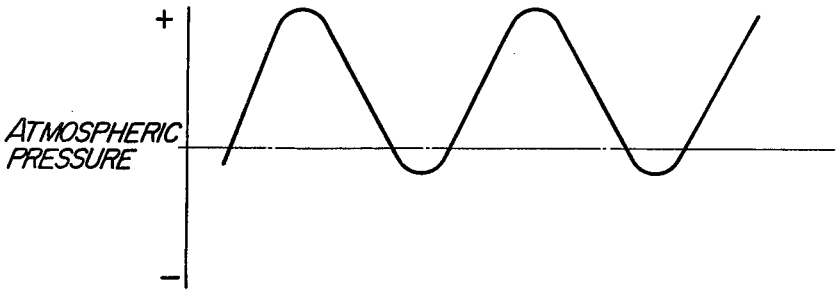
FIG. 8 shows the pressure variation in the diaphragm chamber 14 of the first embodiment.
Figure 9:
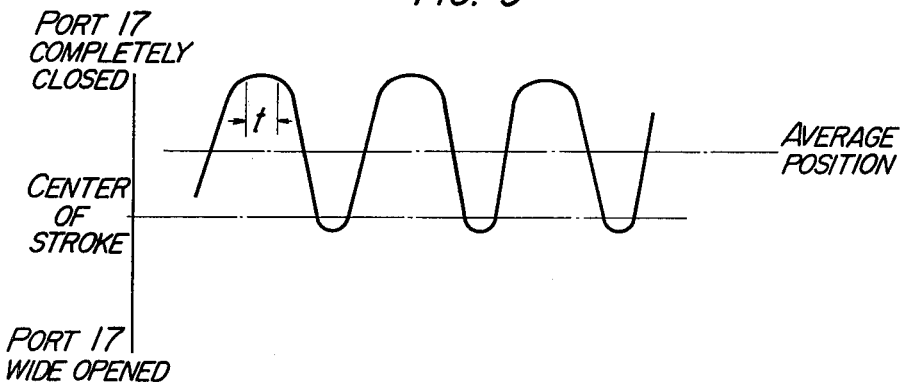
FIG. 9 is a stroke-time diagram of the valve body 16, the diagram being used for the explanation of the mode of operation of the first embodiment.

With the orifice 30 which is contoured as described above, the resistance to the flow of the exhaust gases from the diaphragm chamber 14 toward the constant pressure chamber 22 (See FIG. 6) of the exhaust gas control valve 2 is increased, but the resistance to the flow from the constant pressure chamber 22 to the diaphragm chamber 14 is reduced. As a result, when the pressure in the constant pressure chamber 22 changes as shown in FIG. 2, the pressure in the diaphragm chamber 14 changes sinusoidally as shown in FIG. 8. Since the positive pressure may be maintained for a longer time in the diaphragm chamber 14, the valve body 16 on the diaphragm 15 (See FIG. 6) operates as shown in FIG. 9. It can be seen that the average position of the valve body 16 is further offset upward toward the upper stroke end (where the port 17 is completely closed) and that the peak of the stroke wave is more flattened. As a result the negative pressure transmission time t is increased, and the decrease as well as variation in the negative pressure to be transmitted to the exhaust gas control valve 2 (See FIG. 6) may be avoided, whereby the NOx emission may be satisfactorily suppressed and unstable operation of the control valve 2 may be avoided.

Figure 10:
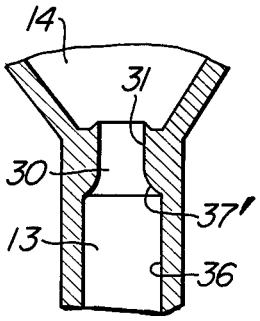
FIGS. 10 and 11 are sectional views showing orifice arrangements of second and third embodiments, respectively, of the present invention.

Second Embodiment, FIG. 10

The second embodiment shown in FIG. 10 is substantially similar to the first embodiment shown in FIGS. 6 and 7 except that the lower end of the orifice hole 30 is gradually enlarged in diameter toward the internal cylindrical surface 36 of the back pressure inlet port 13 to form a bell-mouthed surface 37'. This embodiment has the same advantage as described with reference to the first embodiment shown in FIGS. 6 and 7.

Figure 11:
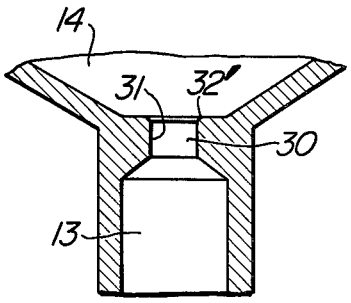

Third Embodiment, FIG. 11

The third embodiment shown in FIG. 11 is substantially similar to the first embodiment shown in FIGS. 6 and 7 except that the upper end 32'' of the orifice hole 30 is opened on a flat surface perpendicular to the axis of the orifice and is slightly bevelled. As with the first embodiment, the resistance to the flow of exhaust gases from the diaphragm chamber 14 to the constant pressure chamber 22 is greater than the resistance to the flow from the constant pressure chamber 22 to the diaphragm chamber 14 so that the positive pressure may be sustained for a longer time in the diaphragm chamber 14. Therefore the effects of the third embodiment are same with those of the first embodiment described above.

As described above, the present invention provides an exhaust gas recirculation system wherein an orifice which is interposed between a diaphragm chamber of a modulator valve and a constant pressure chamber of an exhaust gas control valve is so contoured that the resistance to the flow of the exhaust gases from the diaphragm chamber to the constant pressure chamber is greater than the resistance to the flow from the constant pressure chamber to the diaphragm chamber. Therefore the positive pressure of the pulsating pressure may be trapped in the diaphragm chamber for a longer time period so that the decrease as well as variation in the negative pressure transmitted to the exhaust gas control valve may be avoided. As a result, the recirculation of the exhaust gases in a desired amount may be always ensured so that the NOx emission may be satisfactorily suppressed and the variation in NOx emission may be prevented.

What is claimed is:

1. An exhaust gas recirculation system comprising:

an exhaust gas recirculation passage for recirculating part of the exhaust gases discharged from an engine from an exhaust system to an intake system of the engine;

a control valve for controlling the flow rate of the exhaust gases to be recirculated in response to a pressure signal, said control valve having an internal passage which is part of said exhaust gas recirculation passage, a valve head placed in said internal passsage for changing the flow rate of the exhaust gases to be recirculated and a constant pressure chamber upstream of said valve head;

a modulator valve for applying said pressure signal to said control valve, said modulator valve having a diaphragm chamber for controlling said pressure signal, a conduit for connecting said constant pressure chamber with said diaphragm chamber for applying the pressure of the exhaust gases in said constant pressure chamber to said diaphragm chamber; and an orifice means located between said diaphragm chamber and said conduit for controlling the resistance to the flow of the exhaust gases from said diaphragm chamber to said constant pressure chamber to be higher than the resistance to the flow from said constant pressure chamber to said diaphragm chamber.

2. An exhaust gas recirculation system as set forth in claim 1, wherein said orifice means has an internal cylindrical surface, one end of said internal cylindrical surface on the side of said diaphragm chamber is surrounded with an external, truncated conical surface which is coaxial with said internal cylindrical surface and which is converged toward the interior of said diaphragm chamber; and the other end of said internal cylindrical surface of the side of said constant pressure chamber is contiguous with an internal, truncated conical surface which is coaxial with said internal cylindrical surface and which is diverged toward said constant pressure chamber.

3. An exhaust gas recirculation system as set forth in claim 2, wherein the angle between said internal cylindrical surface and said external truncated conical surface is between about 90° and 150°; and the angle between said internal cylindrical surface and said interanl truncated conical surface is between about 10° and 70°.

4. An exhaust gas recirculation system as set forth in claim 1, wherein said orifice means has a through hole with an internal cylindrical surface; and one end of said orifice hole on the side of said constant pressure chamber is terminated into a bell-mouth shape.

5. An exhaust gas recirculation system as set forth in claim 4, wherein the other end of said orifice hole on the side of said diaphragm chamber is surrounded with an external truncated conical surface which is coaxial with said internal cylindrical surface and which is converged toward the interior of said diaphragm chamber.

6. An exhaust gas recirculation system as set forth in claim 1, wherein said orifice means has a through hole with an internal cylindrical surface, one end of said orifice hole on the side of said diaphragm chamber is opened on a flat surface perpendicular to the axis of said orifice hole, and the other end of said orifice hole on the side of said constant pressure chamber is contiguous with an internal, truncated conical surface which is coaxial with said internal cylindrical surface and which is diverged toward said constant pressure chamber.

7. An exhaust gas recirculation system as set forth in claim 6, wherein said one end of said orifice hole is bevelled.

* * * * *